US006869755B2

(12) United States Patent
Mooney, III et al.

(10) Patent No.: US 6,869,755 B2
(45) Date of Patent: Mar. 22, 2005

(54) ELEMENTS FOR FORMING PRINT-OUT IMAGES

(75) Inventors: William Frank Mooney, III, Sayre, PA (US); David Raymond Logrando, Sayre, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/027,424

(22) Filed: Dec. 20, 2001

(65) Prior Publication Data

US 2002/0146649 A1 Oct. 10, 2002

Related U.S. Application Data

(63) Continuation-in-part of application No. 09/521,536, filed on Mar. 8, 2000, now abandoned.

(51) Int. Cl.[7] ..... G03C 1/73

(52) U.S. Cl. ..... 430/334; 430/346; 430/339; 430/338; 430/332

(58) Field of Search ..... 430/346, 334, 430/332, 339, 338

(56) References Cited

U.S. PATENT DOCUMENTS

| | | | | |
|---|---|---|---|---|
| 3,445,234 A | | 5/1969 | Cescon et al. | 96/90 |
| 3,658,542 A | | 4/1972 | Henry, Jr. et al. | 96/90 |
| 3,658,543 A | | 4/1972 | Gerlach, Jr. et al. | 96/90 |
| 3,672,933 A | | 6/1972 | Lieberman | 117/34 |
| 3,674,534 A | | 7/1972 | Connair | 117/34 |
| 4,311,783 A | | 1/1982 | Dessauer | 430/270 |
| 4,622,286 A | | 11/1986 | Sheets | 430/343 |
| 4,962,009 A | * | 10/1990 | Washizu et al. | 430/138 |
| 4,962,013 A | * | 10/1990 | Tateoka et al. | 430/337 |

FOREIGN PATENT DOCUMENTS

| | | | | |
|---|---|---|---|---|
| EP | 0602893 A1 | | 6/1994 | B41M/5/38 |
| JP | 55-156938 A | * | 12/1980 | G03C/1/72 |

OTHER PUBLICATIONS

Ricoh Co. (94:217579) CA, copyright 2003 ACS, English abstract of JP 55156938 A2 issued Dec. 1980, one page.*

Ricoh KK (Derwent–Acc–NO: 1981–10444D), Derwent Week 198107, English abstract of JP 55156938 A publication date of Dec. 6, 1980, two pages, copyright 1999, Derwent Information Ltd.*

Taniguchi et al (Pat–no. JP355156938A) English abstract of JP 55156938 A2 issued Dec. 1980, one page, copyright 1980, JPO Japio.*

* cited by examiner

*Primary Examiner*—Cynthia Hamilton
(74) *Attorney, Agent, or Firm*—Thomas H. Magee

(57) ABSTRACT

An element for forming a print-out image containing a substrate, which may be cellulose, having a first surface and a second surface; a dye forming composition on the first surface of the substrate; and a non-dye forming composition on the second surface of the substrate having at least one hydrogen donor compound.

28 Claims, No Drawings

ELEMENTS FOR FORMING PRINT-OUT IMAGES

This is a continuation-in-part of U.S. Ser. No. 09/521,536 filed on Mar. 8, 2000, now abandoned, which is incorporated herein by reference in its entirety.

FIELD OF THE INVENTION

This invention relates to an element capable of forming print-out images having a dye forming composition on one side.

BACKGROUND OF THE INVENTION

Dye forming compositions utilizing hexaarylbiimidazole compounds in admixture with a leuco dye, as well as other additives, are known. A "dye forming" composition is one that contains at least one relatively colorless compound, for example a leuco dye, that can form color as a result of application of energy to the composition. Many of these compositions are less sensitive to radiation in the longer wavelength range of the ultraviolet spectrum. Dye forming compositions disclosed in Sheets, U.S. Pat. No. 4,622,286 and Dessauer U.S. Pat. No. 4,311,783 contain a leuco dye and a 2,4,5-triphenylimidazolyl compound as defined therein, exhibit more spectral sensitivity in longer wavelength regions of the spectrum. In addition, the dye forming compositions have increased radical reactivity. Such dye forming compositions are particularly useful in proofing papers, printout paper, overlay films, etc.

These dye forming compositions are applied to permeable substrates, e.g., cellulosic substrates, to form an element capable of forming print-out images. A "print-out image" is an instantly accessible, discernible colored pattern resulting from exposure to electromagnetic radiation, for example, ultraviolet radiation. The ideal cellulose containing substrate possesses a number of attributes including, but not limited to, appropriate caliper, basis weight, smoothness, dimensional stability, "hand", color, opacity, solvent holdout, and chemical stability in the presence of the photosensitive dye forming compositions. Products currently manufactured include proofing papers which are coated on one or both sides with a dye forming composition. In the marketplace, two-side coated papers are more preferred, but one-side coated papers are less expensive and are more suitable to the workflow of many customers. It has been found, however, that the one-side coated papers may have a tendency towards greater instability with time.

Although substrates have been found that have almost all the attributes outlined above, they fall short in that the dye forming compositions when applied to them can demonstrate physical and/or chemical instability, i.e., the photosensitivity or photoresponse changes over time. It is believed to be the interaction of the permeable substrate and the dye forming composition that causes these instabilities.

Accordingly, there is a need for dye forming composition coated elements having improved photosensitive stability over time for forming print-out images.

DISCLOSURE OF THE INVENTION

In a first aspect, the invention relates to an element for forming a print-out image comprising:

(a) a substrate comprising cellulose having a first surface and a second surface;

(b) a dye forming composition on the first surface of the substrate; and (c) a non-dye forming composition on the second surface of the substrate comprising at least one hydrogen donor compound. A non-dye forming composition is one that lacks a color forming dye compound.

The hydrogen donor compound is selected from any of the group of compounds which may donate a hydrogen atom to the lowest excited triplet state of a photoreducible quinone as defined below. Examples of useful hydrogen donor compounds are selected from those organic compounds containing an amine group, a hydroxy group, a phosphine group, a phosphoramide group, or a β-dialkylaminocarbonyl moiety.

In this first aspect, the invention more specifically relates to an element for forming a print-out image having improved stability wherein the hydrogen donor compound comprises a tertiary amine compound selected from the group consisting of:

(i) a tertiary aliphatic amine compound having the structural formula:

$$(RCH_2)_n(R'CH_2)_mN(Q)_{p-n-m}$$

wherein p=3, n and m are 0, 1 or 2, Q is $CH_2CH_2O_2CR''$ or $CH_2CH_2CO_2R''$ and R, R' and R" are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms; and (ii) a heterocyclic compound having the general structural formula:

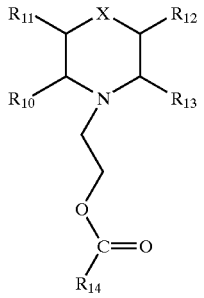

wherein X is an oxygen atom, $CH_2$ group, or a bridge to make a 5-membered cyclic amine, $R_{10}$, $R_{11}$, $R_{12}$, and $R_{13}$ are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atom , and $R_{14}$ is a hydrogen atom, or alkyl group of 1 to 12 carbon atoms, or aryl group of 6 to 10 carbon atoms, or alkylaryl group of 7–20 carbon atoms, or alkolyalkyl group of 1 to 12 carbon atoms.

In this first aspect, the invention still further relates to a process for forming a print-out image having improved stability comprising:

(a) providing a substrate comprising cellulose having a first surface and a second surface;

(b) applying a dye forming composition to the first surface of the substrate; and (c) applying a non-dye forming composition to the second surface of the substrate, wherein the non-dye forming composition comprises the hydrogen donor compound.

In a second aspect, this invention relates to an element comprising a dye forming composition wherein the dye forming composition comprises at least one hydrogen donor compound which is different from a leuco dye.

In this second aspect of the invention, an element comprises a dye forming composition wherein the dye forming composition comprises at least one hydrogen donor, specifically, wherein the hydrogen donor comprises the tertiary amine compound.

In this second aspect, the invention further relates to an element comprising a dye forming composition wherein the dye forming composition comprises:

(1) a film-forming polymeric binder, (2) a photooxidant, (3) a leuco dye, (4) up to 10% by weight, based on the weight of the total composition, of an acid, and (5) a mixture comprising (a) at least one photoreducible quinone, and (b) at least one hydrogen donor compound.

DETAILED DESCRIPTION OF THE INVENTION

The element for forming a print-out image of this invention comprises a substrate, comprising cellulose and having a first surface and a second surface; a dye forming composition present on the first surface of the substrate; and a non-dye forming composition present on the second surface of the substrate comprising at least one hydrogen donor compound.

Substrate

Typically the substrate, comprises cellulose which substrate may be non-permeable to gases or liquids, substantially non-permeable to gases or liquids or it may be permeable, typically by way of pores. The cellulose containing substrate ideally possesses a number of attributes including, but not limited to, appropriate caliper, basis weight, smoothness, dimensional stability, "hand" color, opacity, and solvent holdout. In the presence of dye forming compositions chemical stability is also an important attribute. Both coated and uncoated natural cellulosic papers may be employed in this invention. Typically, paper, usually made from a variety of fibrous raw materials such as wood, recycled pulp, cotton, polyethylene, and fiberglass is used. These substrates may be coated on one or both sides. More typically, the cellulose substrate used is 32HG-3 paper, (manufactured by Schweitzer-Mauduit International, Inc.) with a basis weight of about 74 g/m2, or 50 pound Point Opaque, made by Consolidated Paper, Inc.

Dye Forming Composition

In general, the dye forming composition comprises a film forming polymeric binder; at least one photooxidant; a leuco dye that is oxidizable to a dye by imidazolyl radicals formed by photolysis of the oxidant, 0 to 10% of an acid, and a mixture containing (i) at least one photoreducible quinone, and (ii) at least one hydrogen donor compound which is, typically, a tertiary amine compound.

Polymeric Binder

Various film forming polymeric binders can be used in the compositions of this invention. Suitable binders include, but are not limited to, acrylic homopolymers, such as poly ($C_1$–$C_4$ alkyl acrylates); acrylic copolymers, such as copolymers of ethyl acrylate with other acrylic and methacrylic comonomers; methacrylic homopolymers, such as poly (methyl methacrylate); methacrylic copolymers, such as copolymers of methyl methacrylate with other methacrylic and acrylic comonomers; poly(vinyl butyral); cellulose esters, such as cellulose acetate butyrate; poly(alkylene oxides), such as poly(ethylene oxide); and poly(styrene) homopolymer and copolymers, such as brominated poly (styrene).

Typical binders are cellulose acetate esters and poly(vinyl butyral). Typically, the binder may be present in an amount from about 0.5 part to about 200 parts by weight per part of combined weight of a hexaarylbiimidazole and a leuco dye. Generally about 5 to 20 parts by weight are used.

Leuco Dye

A leuco dye is the reduced form of the dye having one or two hydrogen atoms, the removal of which together with an additional electron, in certain cases, produces the dye. It is known in the dye art that the decolorization of a visibly-colored dye occurs by reduction, with net addition of one or more hydrogen atoms. The change from a visibly-colored dye form to a leuco dye form requires only a small overall change in the structure and mass of the compound but causes a marked visual effect. Many different types of dyes may be formed into a leuco dye. The leuco form of the dye, which comprises one component of the dye forming composition of the present invention, is selected from aminotriarylmethanes, aminoxanthenes, aminothioxanthenes, amino-9,10-dihydroacridines, aminophenoxazines, aminophenothiazines, aminodihydrophenazines, aminodiphenyl methanes, leuco indamines, aminohydrocinnamic acids (cyanoethanes, leuco methines) and corresponding esters, hydrazines, leuco indigoid dyes, amino 2,3-dihydroanthraquinones, tetrahalo-p,p'-biphenols, 2(p-hydroxyphenyl)-4,5-diphenylimidazoles, indanones, phenethylanilines, and combinations thereof.

Such leuco dyes are described, for example, in U.S. Pat. No. 3,445,234, column 2, line 49 to column 8, line 55.

Aminotriarylmethanes are a specifically contemplated class of leuco dye. A preferred class of aminotriarylmethane is characterized by at least two phenyl groups having an $R_aR_bN$-substituent in the position para to the bond to the methane carbon atom wherein each of $R_a$ and $R_b$ can be the same or different hydrogen atom, $C_1$–$C_{10}$ alkyl groups, 2-hydroxyethyl, 2-cyanoethyl, and benzyl and a third aryl group may be the same as or different from the first two aryl groups, and when different, is selected from the following:

(a) Phenyl which can be substituted with lower alkyl, lower alkoxy, alkylamido, chloro, dialkylamino, diphenylamino, cyano, nitro, hydroxy, fluoro or bromo;

(b) Naphthyl which can be substituted with amino, di-lower alkylamino, alkylamino;

(c) Pyridyl which can be substituted with alkyl;

(d) Quinolyl;

(e) Indolinylidene which can be substituted with alkyl; and (f) Thienyl.

Typically, $R_a$ and $R_b$ are hydrogen or lower alkyl group of 1–4 carbon atoms. Typically the alkyl groups of the above noted substituents are also lower alkyl groups of 1–4 carbon atoms.

Examples of category (a) aminotriarylmethane leuco dyes are illustrated by chemical structures I through VII below. Within this category (a) of aminotriarylmethane leuco dyes, suitable aminotriarylmethane leuco dyes include, but are not limited to, LCV, D-LCV, LECV, D-LECV, LPCV, LBCV and LV-1. Also included are aminotriarylmethane leuco dyes having different alkyl substituents bonded to the amino moieties wherein each alkyl group is independently selected from $C_1$–$C_4$ alkyl, and aminotriarylmethane leuco dyes comprising any of the preceding named structures that are further substituted with one or more alkyl groups on the aryl rings wherein the latter alkyl groups are independently selected from $C_1$–$C_3$ alkyl. (The chemical names for each of these aminotriarylmethane acronyms are listed in the Examples glossary below.) Typical aminotriarylmethane leuco dyes according to this invention are:

LCV Leuco Crystal Violet; tris(N,N-dimethylaminophenyl)methane=4,4',4"-methylidynetris(N,N-dimethyl)benzenamine LECV tris(N,N-diethylaminophenyl)methane=4,4',4"-methylidynetris(N,N-diethyl)benzenamine LV-2 bis(4-diethylamino-2-methylphenyl)(4-diethylamino-phenyl)methane LV-1 bis(4-N,N-diethylaminophenyl)-(4-N,N-diethylamino-2-methyl-phenyl)methane D-LECV Deutero Leuco Ethyl Crystal Violet; tris(4-N,N-diethylaminophenyl)-1-deuteromethane LPCV tris(N,N-di-n-propylaminophenyl)methane=4,4',4"-methylidynetris(N,N-di-i-propyl)benzenamine LBCV tris(N,N-di-n-butylaminophenyl)methane=4,4',4"-methylidynetris(N,N-di-n-butyl)benzenamine D-LCV Deutero-Leuco Crystal Violet; tris(4-N,N-dimethylaminophenyl)-1-deuteromethane TLA-454 4,4',4"-methylidynetris[N,N-diethyl-3-methylbenzenamine]

LMG Leuco Malachite Green; 4,4'-(phenylmethylene)-bis[N,N-dimethylbenzenamine]

D-LV-1 bis(4-N,N-diethylaminophenyl)-(4-N,N-diethylamino-2-methylphenyl)-1-deuteromethane More typical aminotriarylmethane leuco dyes in this invention are LCV, TLA-454 and LV-1.

Some typical triphenylmethane leuco dyes are represented by the following formulae: Leuco Crystal Violet (Ib), Deutero-Leuco Crystal Violet (IIb), Leuco Ethyl Crystal Violet (Ic), Deutero Leuco Ethyl Crystal Violet (IIc), and the mono-methyl LCV (i.e., all R and $X_3$ groups are $CH_3$) (Ie) and its deutero analog (IIe, wherein all R groups are $CH_3$).

I

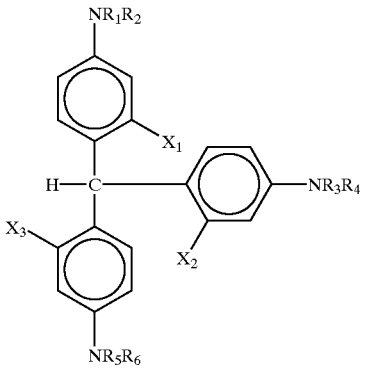

-continued

II

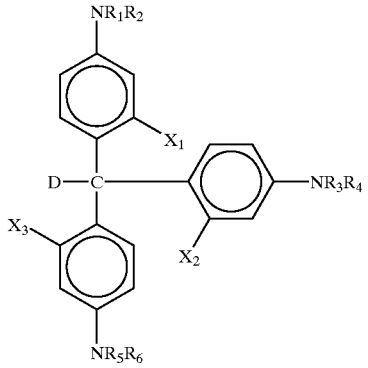

For chemical structures I and II:

a) $X_1$, $X_2$ and $X_3$ are H; $R_1$ through $R_6$ are H.

b) $X_1$, $X_2$ and $X_3$ are H; $R_1$ through $R_6$ are $CH_3$.

c) $X_1$, $X_2$ and $X_3$ are H; $R_1$ through $R_6$ are $C_2H_5$.

d) $X_1$, $X_2$ and $X_3$ are H; $R_1$ through $R_6$ are independently selected from H and $C_3$–$C_8$ alkyl.

e) $X_1$ and $X_2$ are H; $X_3$ is $CH_3$; $R_1$ through $R_6$ are independently selected from H and $C_1$–$C_8$ alkyl.

f) $X_1$ is H; $X_2$ and $X_3$ are $CH_3$; $R_1$ through $R_6$ are independently selected from H and $C_1$–$C_8$ alkyl.

g) $X_1$, $X_2$ and $X_3$ are H; $R_1$, $R_3$ and $R_5$ are independently selected from aryl $C_6$–$C_{10}$; substituted $C_6$–$C_{10}$ aryl; and $R_2$, $R_4$, and $R_6$ are H.

III

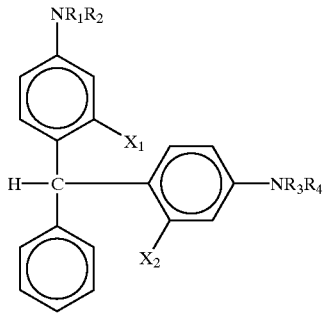

IV

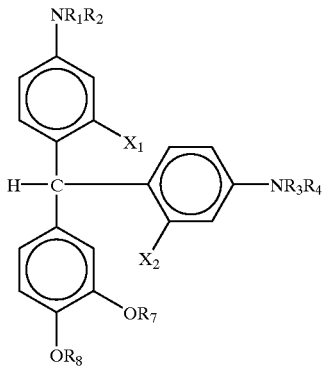

V

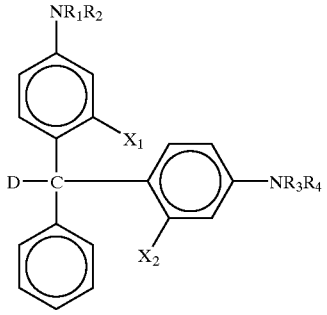

VI

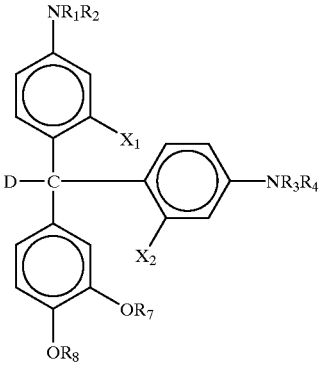

For chemical structures III through VI:

a) $X_1$ and $X_2$ are H; and $R_1$ through $R_4$ are independently selected from H and $C_1$–$C_8$ alkyl b) $X_1$, $X_2$=H and $R_1$ and $R_3$ are aryl; and $R_2$ and $R_4$ are H c) $X_1$=$CH_3$, $X_2$=H and $R_1$ through $R_4$ are independently selected from H and $C_1$–$C_8$ alkyl; and $R_7$ and $R_8$ are independently selected from $C_1$–$C_8$ alkyl, or $R_7$ and $R_8$ or are bridged to form a cyclic attachment with a $CH_2$— or $C_2H_4$— bond, thereby forming a five- or six-membered ring, respectively.

VII

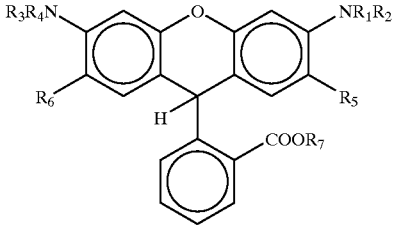

For chemical structure VII:

a) R is independently selected from H, $C_1$–$C_8$ alkyl; $R_5$ and $R_6$ are independently selected from H and $C_1$–$C_4$ alkyl; $R_1$ through $R_4$ are independently selected from H and $C_1$–$C_6$ alkyl, $C_6$–$C_{10}$ aryl with the proviso that, if $R_1$ and $R_3$ are aryl, then $R_2$ and $R_4$ are hydrogen.

Typical leuco dyes in this invention include, but are not limited to, aminotriarylmethanes, indanones, and aminoxanthenes.

Indanones

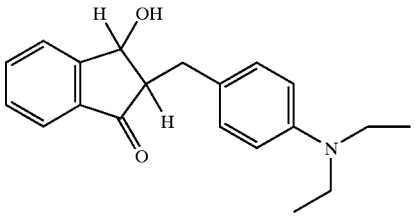

The leuco dye(s) can be present in the compositions in the amount of at least about 3% by weight, typically about 4% to about 20% by weight. Deuterium is meant by the symbol "D" in the above structures.

PhotoOxidant

The photooxidation system of the dye-forming composition is described below.

Photooxidants useful in the present invention are known as the hexaarylbiimidazoles, which include certain 2,4,5,2',4',5'-hexaarylbiimidazole compounds (HABI). A HABI oxidation system includes at least one HABI compound which furnishes free radicals when photoactivated. In the imaging systems of this invention, the generation of free radicals form an image, such as, for example, by leuco dye oxidation to form color.

Certain substituted 2,4,5,2',4',5'-hexaarylbiimidazole compounds useful in this invention are disclosed in: Chambers, U.S. Pat. No. 3,479,185; Cescon, U.S. Pat. No. 3,784,557; Dessauer, U.S. Pat. No. 4,311,783; and Sheets, U.S. Pat. No. 4,622,286.

The 2-aryl groups of the HABIs disclosed in these and related patents are themselves substituted in the 2 and 2' positions (for example, o-chloro (o-Cl) or o-alkoxy (o-OR), where R is selected from $C_1$–$C_8$ alkyl). The structure of useful HABIs include hexaphenylbiimidazoles in which the other positions on the phenyl substituents are unsubstituted or substituted with chloro, methyl or alkoxy, are believed to be as follows:

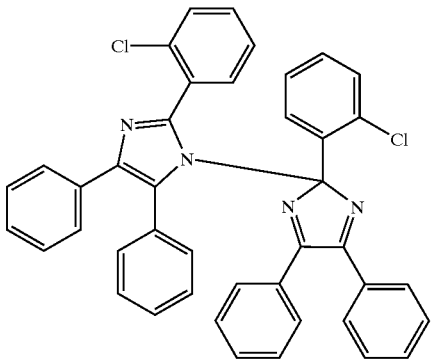

-continued

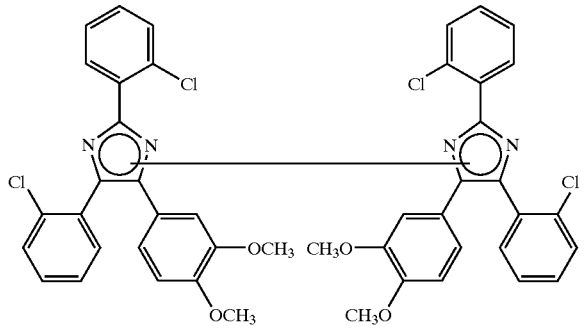

The HABI compounds described below may be formed by the oxidation of triarylimidazoles and can exist as different isomers, the structure of the predominant one is listed as such:

CDM-HABI the substance formed by the oxidation of 2-(o-chlorophenyl-4,5-di-(3,-methoxyphenyl imidazole; the predominant isomer is unknown. [CAS Registry #29864-34-4]

o-Cl-HABI the substance formed by oxidation of 2-(o-chlorophenyl)-4,5-diphenyl-imidazole; the predominant isomer is 1H -imidazole, 2-(2-chlorophenyl)-1-[2-(2-chlorophenyl)-4,5-diphenyl-2H-imidazol-2-yl]-4,5-diphenyl-[CAS Registry #1707-68-2]

o-EtO-HABI the substance formed by oxidation of 2-(2-ethoxyphenyl)-4,5-diphenyl imidazole; the predominant isomer is 1H-imidazole, 2-(2-ethoxyphenyl)-1-[2-(2-ethoxyphenyl)-4,5-diphenyl-2H-imidazol-2-yl]-4,5-diphenyl- [GAS Registry #29864-18-4]

TCTM-HABI the substance formed by oxidation of 2,4-(2-chlorophenyl)-5-(3,4-dimethoxyphenyl)-1H-imidazole. The predominant isomer is unknown. [CAS Registry #233767-21-0]

TCDM-HABI the substance formed by co-oxidation of 2,4-(2-chlorophenyl)-5-(3,4-dimethoxyphenyl)-1H-imidazole and 2-(2-chlorophenyl)-4,5-diphenyl-1H-imidazole which gives rise to at least two unique isomers as well as the o-Cl-HABI and TCTM-HABI substances described supra. The predominant isomer is unknown. [CAS Registry #100486-97-3]

Some suitable HABI compounds for this invention include, but are not limited to, all those listed in this specification. HABIs may be used in combination with another, for example, a mixture of o-Cl-HABI and o-EtO-HABI.

Typical HABI compounds (HABIs) for this invention include CDM-HABI, TCDM-HABI and TCTM-HABI.

The HABI compounds can be present in this invention in the amount of from about 1% to about 10% by weight, more typically from about 2 to about 4% by weight, based on the weight of the total composition.

Acid

The dye forming composition may comprise 0 to about 10% of an acid. The acid concentration may be zero in the case where a co-oxidant and/or photoacid generator, such as tribromomethylphenylsulfone, are used instead. Some suitable acids include dodecylbenzenesulfonic acid, richonic acid, and p-toluenesulfonic acid monohydrate.

Photoreducible Quinone

Some suitable photoreducible quinones contemplated for use in the dye forming composition are described in U.S. Pat. No. 3,658,543, column 9, lines 1 to 46. Typical photoreducible quinones include 1,6-pyrenequinone, 1,8-pyrenequinone, 9,10-phenanthrenequinone and mixtures thereof, which absorb principally in the 400 to 550 nm region. The amount of photoreducible quinone is based on the photooxidant used and molar ratios of from about 0.01:1 to about 2:1 may be typically employed, with ratios of about 0.2:1 to about 0.6:1 more typically employed.

The hydrogen donor compound is a compound which may donate a hydrogen atom to the lowest excited triplet state of a photoreducible quinone. Examples of useful hydrogen donor compounds are organic compounds containing an amine group, a hydroxy group, a phosphine group, a phosphoramide group, or a β-dialkylaminocarbonyl moiety. Typically, the hydrogen donor compound comprises at least one tertiary amine compound which is selected from the group consisting of:

(i) an aliphatic amine compound having the structural formula:

$$(RCH_2)_n(R'CH_2)_mN(Q)_{p-n-m}$$

wherein p=3, n and m are 0, 1 or 2, Q is $CH_2CH_2O_2CR''$ or $CH_2CH_2CO_2R''$ and R, R' and R" are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms; and (ii) a cyclic amine having the structural formula:

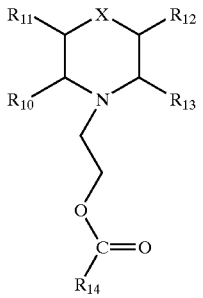

wherein X is an oxygen atom, $CH_2$ group or a bridge to make a 5-membered cyclic amine, $R_{10}$, $R_{11}$, $R_{12}$, and $R_{13}$ are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms , and $R_{14}$ is a hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms.

Some examples of aliphatic amine compounds include triethanolamine triacetate, triethanolamine tripronionate, triethanolamine tributyrate, triethanolamine trivalerate, N,N-dibenzylethanolamine acetate, N,N-dibenzylethanolamine propionate, N,N-dibenzylethanolamine butyrate, N-benzyl (diethanolamine diacetate). Some examples of cyclic amines include 4-(2-hydroxyethyl)morpholine acetate, 4-(2-hydroxyethyl)morpholine propionate, 1-piperidineethanol acetate, 1-pyrrolidineethanol acetate. Typically triethanolamine triacetate or N,N-dibenzylethanolamine acetate are used. These compounds are readily prepared by esterification of a suitable carboxylic acid, or its derivative such as an acid chloride or anhydride, with triethanolamine, or by transesterification. Typical processes for their preparation are disclosed in the *Journal of American Chemical Society*, 47, 2,966 (1925) or *Journal of Chemical Society, Japan, Ind. Chem. Section*, 57, 402 (1954).

The molar ratios of the tertiary amine compound to the photooxidant are about 1:1 to about 90:1, preferably 10:1 to 20:1.

Additives

Inert infusible fillers may be employed in the dye forming composition. Examples of inert infusible fillers include titanium dioxide, organophilic colloidal silica, bentonite, powdered glass, micron-sized alumina and mica in minor, noninterfering amounts. Formulations containing micron-sized amorphous silicas, as, for example, the "Syloid" silica gels, sold by W. R. Grace & Co., are particularly useful for providing a "tooth" for pencil or ink receptivity and eliminating blocking tendencies.

With some polymeric binders, it is desirable to add a plasticizer, e.g., solid or liquid, to give flexibility to the film or coating. Suitable plasticizers such as Merpol® 2660 are disclosed in U.S. Pat. No. 3,658,543, column 10, lines 20 to 73, incorporated herein by reference. A typical liquid plasticizer is nonylphenoxypoly-(ethyleneoxy)ethanol. A typical solid plasticizer is N-ethyl-p-toluenesulfonamide. Other commercially available phthalate esters (e.g., alkyl benzyl phthalates), benzenesulfonamides/toluenesulfonamides (e.g., N-ethyl-o(or p)-toluenesulfonamide; and N-(n-Butyl) benzenesulfonamide) may also be suitable plasticizers. A specific example of a suitable plasticizer is 1,2 benzenedicarboxylic acid, butyl phenylmethyl ester commercially available under the name "Santicizer 160", and 2(or 4)methyl-benzensulfonamide commercially available under the name "Uniplex 171" which is a mixture of the two isomers. The plasticizers can be used in total concentrations ranging from 1:20 to 5:3, preferably 1:5 to 1:2, based on the weight of polymeric binder used. Light stabilizers such as substituted 2-(hydroxyphenyl)benzotriazoles may also be useful in this invention.

In preparing the dye forming and the non dye forming formulations, generally inert solvents are employed which are volatile at ordinary pressures. Examples include alcohols and ether alcohols such as methanol, ethanol, 1-propanol, 2-propanol, butanol, and ethylene glycol; esters such as methyl acetate and ethyl acetate; aromatics such as benzene, o-dichlorobenzene and toluene; ketones such as acetone, methyl ethyl ketone and 3-pentanone; aliphatic halocarbons such as methylene chloride, chloroform, 1,1,2,-trichloroethane, 1,1,2,2-tetrachloroethane and 1,1,2-trichloroethylene; miscellaneous solvents such as dimethylsulfoxide, pyridine, tetrahydrofuran, dioxane, dicyanocyclobutane and 1-methyl-2-oxo-hexamethyleneimine; and mixtures of these solvents in various proportions as may be required to attain solutions. It may be beneficial to leave a small residue of solvent in the dried composition so that the desired degree of imaging can be obtained upon subsequent irradiation.

Antiblocking agents, such as Zonyl® FTS, may also be employed on one or both sides of the substrate to prevent the coatings from adhering to one another.

Still another additive in the dye forming composition is an energy-transfer dye of the type disclosed in U.S. Pat. No. 3,479,185, column 5, lines 57 to 74. Generally such energy-transfer dyes are present in about 0.5 to 3.0% by weight based on the weight of solids including binder component, if present. Other energy transfer dyes are included in U.S. Pat. Nos. 3,479,185, 3,533,797 and 3,647,467.

The non-dye forming composition of this invention comprises a hydrogen donor compound. The hydrogen donor compound may be elected from the group of compounds which may donate a hydrogen atom to the lowest excited triplet state of a photoreducible quinone as defined above. Typically the hydrogen donor is selected from the group recited above for the dye forming composition. More typically, the hydrogen donor comprises a tertiary amine compound as previously described.

Some specific examples of useful aliphatic tertiary amine compounds contemplated are triethanolamine triacetate (TEATA), triethanolamine tripropionate triethanolamine tributyrate, triethanolamine trivalerate, N,N-dibenzylethanolamine acetate, N,N-dibenzylethanolamine propionate, N,N-dibenzylethanolamine butyrate and N-benzyl(diethanolamine diacetate). Other useful aliphatic amines include triethylamine, tripropylamine, tribenzylamine, and tetraethylethylenediamine tetraacetate.

Some specific examples of useful cyclic tertiary amine compounds are 4-(2-hydroxyethyl)morpholine acetate, 4-(2-hydroxyethyl)morpholine propionate, 1-piperidineethanol acetate, 1-pyrrolidineethanol acetate, and 1-benzyl-4-piperidone.

Typically triethanolamine triacetate or N,N-dibenzylethanolamine acetate are used. These compounds are readily prepared by esterification of a suitable carboxylic acid, or its derivative such as an acid chloride or anhydride, with triethanolamine, or by transesterification. Typical processes for their preparation are disclosed in the *Journal of American Chemical Society*, 47, 2,966 (1925) or *Journal of Chemical Society, Japan, Ind. Chem. Section*, 57, 402 (1954).

The hydrogen donor compound is present in the amount of about 2 to about 20% by weight, more typically in the amount of about 5 to about 10% by weight, based on the weight of the total non dye forming composition.

In addition to the above described tertiary amines, other hydrogen donor compounds are contemplated including hydroxy group-containing compounds, for example aliphatic alcohol such as 2-propanol, hydrobenzoin(1,2-diphenylethanediol)benzhydrol, phenol, 2,6-di-t-butyl-4-methylphenol; polyols such as poly(ethylene glycol), examples of commercially available poly(ethylene) glycol include Carbowax® 600 Carbowax® 550 (sold by Union Carbide Corporation/The Dow Chemical Company), Igepal®-CO-210 (sold by GAF), or Merpol® 2660 (sold by E. I. du Pont de Nemours and Company); poly(propylene glycol); compounds containing a phosphine group, such as methylenebis(diphenylphosphine); compounds containing a phosphoramide group such as phosphoramide, hexamethylphosphoramide or hexaethylphosphoramide; compounds containing a carboxylic acid group or ester of carboxylic acid, such as succinic acid ester, such as diethyl succinate; 2-imidazolidones, such as ethylene urea or N-methoxyethylethylene urea; Mannich bases, such as TMNTP (trimethyl nitrilotripropionate).

Binders and Additives

The non-dye forming composition may also comprise polymeric binders of the kind previously described for the dye forming composition. Some suitable binders include cellulose acetate butyrate, cellulose acetate propionate and polyvinyl butyral. Useful additives for the non-dye forming composition are plasticizers, quinones, surfactants, fillers (materials that will not melt under the conditions of use), matting agents or antiblocking agents as described above for the dye forming composition as previously described for the dye forming composition.

Process

For imaging uses, the dye forming and the non-dye forming compositions of this invention may be coated upon or impregnated in substrates following known techniques. The compositions, usually as a solution in a carrier solvent described above, may be sprayed, brushed, applied by a reverse roll coater, a roller or an immersion coater, an extrusion dye coater, flowed over the surface, picked up by immersion or spread by other means, and the solvent evaporated.

Any convenient source providing radiation of wavelengths in the range of 200 nm to 400 nm may be used to activate the dye forming composition for triphenylimidazolyl radical formation and print-out image formation. The radiation may be natural or artificial, monochromatic or polychromatic, incoherent or coherent, and should be sufficiently intense for proper activation. Deactivation of the image occurs with visible light, 400–550 nm range.

Conventional light sources include fluorescent lamps, mercury, metal additive and arc lamps. Coherent light sources are the pulsed nitrogen-, xenon, argon ion- and ionized neon-lasers whose emissions fall within or overlap the ultraviolet or visible absorption bands of the photoinitiator. Ultraviolet and near-visible radiation-emitting cathode ray tubes widely useful in printout systems for writing on photosensitive materials are also useful with the subject compositions.

Images may be formed by writing with a beam of the activating light or by exposing to such light a selected area behind a negative, stencil, or other relatively opaque pattern. The negative may be silver on cellulose acetate or polyester film or one in which its opacity results from aggregations of areas having different refractive indices. Image formation may also be effected in conventional diazo printing apparatus, graphic arts exposure or electronic flash equipment and by projection as described in U.S. Pat. No. 3,661,461. The light exposure time may vary from a fraction of a second to several minutes, depending upon the intensity and spectral energy distribution of the light, its distance from the composition, the nature and amount of the composition available, and the intensity of color in the image desired.

These the element for forming the print out image are useful where controlled exposure may yield negative or positive images, e.g., Dylux® proofing papers, printout paper, e.g., for the Du Pont aca® automatic clinical analyzer; garment pattern papers, and heatfix type papers.

EXAMPLES

Glossary:

| | |
|---|---|
| TEATA | triethanolamine triacetate (hydrogen donor) |
| DBEAAc | dibenzylethanolamine acetate (hydrogen donor) |
| PHQ | 9,10-phenanthrenequinone |
| PYQ | mixture of 1,8-pyrenequinone and 1,6-pyrenequinone (photoreducible quinone) |
| TLA-454 | 4,4',4"-methylidynetris[N,N-diethyl-3-methylbenzenamine] (leuco dye) |
| TCDM-HABI | the substance formed by co-oxidation of 2,4-(2-chlorophenyl)-5-(3,4-d imethoxyphenyl)-1 H-imidazole and 2-(2-chlorophenyl)-4,5-diphenyl-1H- imidazole which gives rise to at least two unique isomers as well as the o-CI-HABI and TCTM-HABI substances described supra. The predominant isomer is unknown. [CAS Registry #100486-97-3] |

-continued

| | |
|---|---|
| DBSA | dodecylbenzene sulfonic acid (acid) |
| Zonyl ® FTS | fluorotelomer stearate (antiblocking agent) |
| NETS | N-ethyl-p-toluenesulfonamide (plasticizer) |
| Syloid ® 63 | amorphous silica (filler) |
| Syloid ® 620 | amorphous silica (filler) |
| Merpol ® OPP 2660 | o-phenylphenol adduct with about 2.25 mol of ethylene oxide (plasticizer) |

Example 1

This example describes the preparation of an element having a dye forming composition on a first side of a cellulose containing substrate (also known as the "facecoating") and a non dye forming composition comprising a hydrogen donor composition on a second side of the substrate (also referred to as the "backcoating").

A dye-forming composition with viscosity from 270–320 cP @ 80° F. was prepared as shown in Table 1:

TABLE 1

Dye-forming composition

| Ingredient Name | Solids (g) | % Solids | % of Wet Coating |
|---|---|---|---|
| Acetone | 268,675.37 | N/A | 74.04% |
| Isopropanol (2-propanol) | 26,595.00 | N/A | 7.33% |
| DBSA | 2,177.28 | 3.22% | 0.60% |
| TCDM-HABI | 1,560.38 | 2.31% | 0.43% |
| Syloid ® 63 | 2,068.42 | 3.06% | 0.57% |
| Syloid ® 620 | 508.03 | 0.75% | 0.14% |
| Merpol ® OPP 2660 | 7,547.90 | 11.16% | 2.08% |
| NETS | 8,491.39 | 12.56% | 2.34% |
| TLA-454 | 943.49 | 1.40% | 0.26% |
| TEATA | 4,935.17 | 7.30% | 1.36% |
| PHQ | 254.02 | 0.38% | 0.07% |
| PYQ | 5.08 | 0.01% | 0.00% |
| Zonyl ® FTS | 108.86 | 0.16% | 0.03% |
| CAB-381-20 (cellulose acetate butyrate, 20 sec viscosity) | 26,018.50 | 38.48% | 7.17% |
| CAB-381-0.5 (cellulose acetate butyrate, 0.5 sec viscosity) | 12,991.10 | 19.21% | 3.58% |
| Total Solids: | 67,609.62 | 100.00% | 100.00% |
| Total Solvent: | 295,270.38 | | |
| Total Solution: | 362,880.00 | | |
| % Solids: | 18.63% | | |

A dilute precoat composition with viscosity from 30–45 seconds, #2 Ford Cup @ 75° F., was prepared by diluting 145, 152 g of the dye forming composition to 7.5% solids with 217, 728 g of acetone and 2-propanol in the same ratio as in the dye forming composition.

Non-dye forming compositions A, with viscosity=45–55 cP @ 72° F., was prepared as in the following Tables:

TABLE 2

Non-dye-forming composition A

| Ingredient | Solids (g) | % Solids | % of Wet Coating |
|---|---|---|---|
| Acetone | 299,725.01 | N/A | 82.591% |
| Isopropanol (2-propanol) | 29,679.33 | N/A | 8.178% |
| Syloid ® 63 | 1,142.70 | 3.411% | 0.315% |
| Syloid ® 620 | 281.20 | 0.839% | 0.077% |
| Merpol ® OPP 2660 | 3,633.50 | 10.847% | 1.001% |
| NETS | 4,098.50 | 12.236% | 1.129% |
| TEATA | 2,381.90 | 7.111% | 0.656% |

TABLE 2-continued

Non-dye-forming composition A

| Ingredient | Solids (g) | % Solids | % of Wet Coating |
|---|---|---|---|
| PHQ | 140.60 | 0.420% | 0.039% |
| CAB-381-20 (cellulose acetate butyrate, 20 sec viscosity) | 14,560.50 | 43.469% | 4.012% |
| CAB-381-0.5 (cellulose acetate butyrate, 0.5 sec viscosity) | 7,257.62 | 21.667% | 2.000% |
| Total Solids: | 33,496.52 | 100.000% | 100.000% |
| Total Solvent: | 329,404.35 | | |
| Total Solution: | 362,900.87 | | |
| % Solids: | 9.23% | | |

The dilute precoat of the dye forming composition shown in Table 1 was applied to the SMI 32HG-3 paper sheet using a #10 Mayer rod for a wet coat weight of 3–4 lbs/1,000 square feet. Dry coating weight was 0.35–0.55 lbs/1,000 square feet. This coating was dried for 4 seconds in a high velocity impingement oven with an air temperature of 220° F.

Then, the non-dye forming backcoating composition A with TEATA (9.2% solids) was applied to the uncoated side of the substrate opposite to the coated side. The backcoating was applied with a #10 Mayer rod with a wet coat weight of 3–4 lbs/1000 square feet. The coating was then dried for 4 seconds in a high velocity impingement oven with an air temperature of 220° F. This results in a substrate with backcoating side.

Finally, the undiluted dye forming composition shown in Table 1 was applied to the side of the substrate opposite the backcoating side using a reverse-roll applicator at a coat weight of 1.9 lbs/1,000 square feet. This was dried for 2 seconds at 115° F., 2 seconds at 150° F. and finally for 1 second at 90° F., to a residual solvent content of about 23 g/ream to form a facecoating on the side of the substrate opposite to the backcoating.

What is claimed is:

1. An element for forming a print-out image comprising:

(a) a substrate comprising cellulose having a first surface and a second surface;

(b) a dye forming composition on the first surface of the substrate, wherein the die forming composition comprises a film formimg polymeric binder; a photooxidant; a leuco dye; up to 10% by weight, based on the weight of the total composition, of an acid; and a mixture comprising (a) at least one photoreducible quinone, and (b) at least one doner compound; and (c) a non-dye forming composition on the second surface of the substrate comprising at least one hydrogen donor compound.

2. The element of claim 1 wherein at least one of the hydrogen donor compounds is an organic compound containing an amine group, a hydroxy group, a phosphine group, a phosphoramide group, or a β-dialkylaminocarbonyl moiety.

3. The element of claim 2 wherein at least one of the hydrogen donor compounds is selected from the group consisting of:

(i) an aliphatic amine compound having the structural formula:

$$(RCH_2)_n(R'CH_2)_mN(Q)_{p-n-m}$$

wherein p=3, n and m are 0, 1 or 2, Q is $CH_2CH_2O_2CR''$ or $CH_2CH_2CO_2R''$ and R, R' and R" are the same or different hydrogen atom, or alkyl group of 1 to 12 carbon atoms, or aryl group of 6 to 10 carbon atoms, or alkylary group of 7–20 carbon atoms, or alkoxyalkyl group of 1 to 12 carbon atoms; and (ii) a heterocyclic compound having the structural formula:

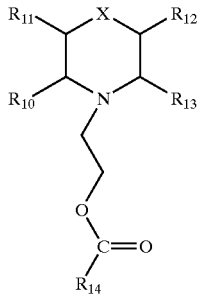

wherein X is an oxygen atom, $CH_2$ group, or a bridge to make a 5-membered cyclic amine, $R_{10}$, $R_{11}$, $R_{12}$, and $R_{13}$ are the same or different, hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms, and $R_{14}$ is a hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms.

4. The element of claim 3 wherein the aliphatic amine compound is present in the amount of about 2 to about 20% by weight, based on the weight of the total composition.

5. The element of claim 2 wherein at least one of the hydrogen donor compounds is triethanol amine triacetate, triethanolamine tripropionate, triethanolamine tributyrate, triethanolamine trivalerate, N,N-dibenzylethanolamine acetate, N,N-dibenzylethanolamine propionate, N,N-dibenzylethanolamine butyrate or N-benzyl(diethanolamine diacetate).

6. The element of claim 2 wherein at least one of the hydrogen donor compounds is 4-(2-hydroxyethyl)-morpholine acetate, 4-(2-hydroxyethyl)-morpholine propionate, 1-piperidineethanol acetate or 1-pyrrolidinathanol acetate.

7. The element of claim 2 wherein at least one of the hydrogen donor compounds is triethanolamine triacetate.

8. The element of claim 2 wherein at least one of the hydrogen donor compounds is N,N-dibenzylethanolamine acetate.

9. The element of claim 2 wherein at least one of the hydrogen donor compounds is 4-(2-hydroxyethyl)-morpholine acetate.

10. The element of claim 1 wherein the hydrogen donor compound in the dye forming composition is an organic compound containing an amine group, a hydroxy group, a phosphine group, a phosphoramide group, or β-dialkylaminocarbonyl moiety.

11. The element of claim 10 wherein the dye forming hydrogen donor compound is selected from the group consisting of:

(i) an aliphatic amine compound having the structural formula:

$$(RCH_2)_n(R'CH_2)_mN(Q)_{p-n-m}$$

wherein p=3, n and m are 0, 1 or 2, Q is $CH_2CH_2O_2CR''$ or $CH_2CH_2CO_2R''$ and R, R' and R" are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms; and (ii) a heterocyclic compound having the structural formula:

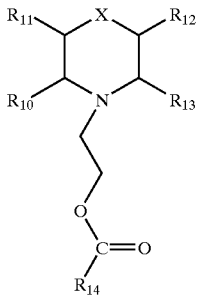

wherein X is an oxygen atom, $CH_2$ group, or a bridge to make a 5-membered cyclic amine, $R_{10}$, $R_{11}$, $R_{12}$, and $R_{13}$ are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms, and $R_{14}$ is a hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms.

12. The element of claim 11 wherein the dye forming hydrogen donor compound is triethanol amine triacetate, triethanolamine tripropionate, triethanolamine tributyrate, triethanolamine trivalerate, N,N-dibenzylethanolamine acetate, N,N-dibenzylethanolamine propionate, N,N-dibenzylethanolamine butyrate or N-benzyl(diethanolamine diacetate).

13. The element of claim 11 wherein the aliphatic amine compound in the dye forming composition is present in the amount of 2 to 20% by weight, based on the weight of the total composition.

14. The element of claim 10 wherein the dye forming hydrogen donor compound is 4-(2-hydroxyethyl)-morpholine acetate, 4-(2-hydroxyethyl)-morpholine propionate, 1-piperidineethanol acetate or 1-pyrrolidineethanol acetate.

15. The element of claim 10 wherein the dye forming hydrogen donor compound is triethanolamine triacetate.

16. The element of claim 10 wherein the dye forming hydrogen donor compound is N,N-dibenzylethanolamine acetate.

17. The element of claim 10 wherein the dye forming hydrogen donor compound is 4-(2-hydroxyethyl)-morpholine acetate.

18. The element of claim 1 wherein the polymeric binder is a cellulose acetate ester.

19. The element of claim 1 wherein the polymeric binder is poly(vinyl butyral).

20. The element of claim 1 wherein the leuco dye is an aminotriarylmethane, aminoxanthene, aminothioxanthene, amino-9,10-dihydroacridine, aminophenoxazine, aminophenothiazine, aminodihydrophenazine, aminodiphenyl methane, leuco indamine, aminohydrocinnamic acid (cyanoethane, leuco methine) and corresponding ester, hydrazine, leuco indigoid dye, amino 2,3-dihydroanthraquinone, tetrahalo-p,p'-biphenol, 2(p-hydroxyphenyl)-4,5-diphenylimidazole, indanone, phenethylaniline, or combination thereof.

21. The element of claim 20 wherein the leuco dye is 4,4',4"-methylidynetris[N,N-diethyl-3-methylbenzenamine].

22. The element of claim 1 wherein the photooxidant is 2,4,5,2',4',5'-hexaaryl-biimidazole dimer.

23. The element of claim 22 wherein the 2,4,5,2',4',5'-hexaaryl-biimidazole compound is TCDM-HABI.

24. The element of claim 1 wherein the acid is dodecylbenzene sulfonic acid, p-toluene sulfonic acid, lower alkyl toluene sulfonic acid or higher alkyl toluene sulfonic acid.

25. The element of claim 1 wherein the acid is dodecylbenzene sulfonic acid.

26. The element of claim 1 wherein the photoreducible quinone is 1,6-pyrenequinone, 1,8-pyrenequinone, 9,10-phenanthrenequinone or mixtures thereof.

27. A process for forming a print-out image comprising:

(a) providing a substrate comprising cellulose having a first surface and a second surface;

(b) applying a dye forming composition to the first surface of the substrate, wherein the dye forming composition comprises a film forming polymeric binder; a photooxidant, a leuco dye; up to 10% by weight, based on the weight of the total composition, of an acid; and a mixture comprising (a) at least one photoreducible quinone, and (b) at least one hydrogen donor compound; and (c) applying a non-dye forming composition to the second surface of the substrate, wherein the non-dye forming composition comprises at least one hydrogen donor compound.

28. The process of claim 27 wherein at least one of the hydrogen donor compounds is selected from the group consisting of:

(i) an aliphatic amine compound having the structural formula:

$$(RCH_2)_n(R'CH_2)_mN(Q)_{p-n-m}$$

wherein p=3, n and m are 0, 1 or 2, Q is $CH_2CH_2O_2CR''$ or $CH_2CH_2CO_2R''$ and R, R' and R" are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms; and (ii) a heterocyclic compound having the structural formula:

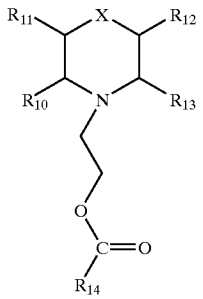

wherein X is an oxygen atom, $CH_2$ group, or a bridge to make a 5-membered cyclic amine, $R_{10}$, $R_{11}$, $R_{12}$, and $R_{13}$ are the same or different hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms, and $R_{14}$ is a hydrogen atom, or alkyl group of 1 to 12 carbon atoms, or aryl group of 6 to 10 carbon atoms, or alkylaryl group of 7–20 carbon atoms, or alkoxyalkyl group of 1 to 12 carbon atoms.

* * * * *